US010726805B2

(12) United States Patent
Huang et al.

(10) Patent No.: US 10,726,805 B2
(45) **Date of Patent: *Jul. 28, 2020**

(54) SOURCE DRIVER AND OPERATING METHOD THEREOF

(71) Applicant: Raydium Semiconductor Corporation, Hsinchu (TW)

(72) Inventors: Chih Chuan Huang, Kaohsiung (TW); Yu-Yuan Chang, Hsinchu (TW); Wen-Fa Hsu, New Taipei (TW)

(73) Assignee: Raydium Semiconductor Corporation, Hsinchu County (TW)

( * ) Notice: Subject to any disclaimer, the term of this patent is extended or adjusted under 35 U.S.C. 154(b) by 61 days.

This patent is subject to a terminal disclaimer.

(21) Appl. No.: 16/118,597

(22) Filed: Aug. 31, 2018

(65) Prior Publication Data

US 2019/0073979 A1 Mar. 7, 2019

Related U.S. Application Data

(60) Provisional application No. 62/553,184, filed on Sep. 1, 2017.

(51) Int. Cl.
*G09G 5/00* (2006.01)
*G09G 3/36* (2006.01)

(52) U.S. Cl.
CPC ..... *G09G 3/3688* (2013.01); *G09G 3/3614* (2013.01); *G09G 2310/0289* (2013.01); *G09G 2310/0291* (2013.01); *G09G 2310/08* (2013.01); *G09G 2330/021* (2013.01)

(58) Field of Classification Search
CPC ..... G09G 3/3688; G09G 3/3614; G09G 2330/021; G09G 2310/08; G09G 2310/0291; G09G 2310/0289; G09G 2340/0435; G09G 3/3685; G09G 3/3611
See application file for complete search history.

(56) References Cited

U.S. PATENT DOCUMENTS

2014/0078129 A1* 3/2014 Hong ..... G09G 5/00 345/212
2016/0171942 A1* 6/2016 Chang ..... G09G 3/3648 345/87

* cited by examiner

*Primary Examiner* — Adam R. Giesy

(57) ABSTRACT

A display driving apparatus applied to a panel is disclosed. The panel displays a first image with a first refresh rate. A first refresh cycle corresponding to the first refresh rate includes a refresh period and at least one non-refresh period. The display driving apparatus includes a real-time determination module and a data processing module. The real-time determination module is coupled to the panel and used to immediately determine whether the panel wants to replace the originally displayed first image with a second image during the first refresh cycle. The data processing module is coupled to the real-time determination module and the panel. If a determination result of the real-time determination module is yes, the data processing module immediately controls the panel to start to display the second image at a first time during the first refresh cycle.

3 Claims, 12 Drawing Sheets

SOURCE DRIVER AND OPERATING METHOD THEREOF

BACKGROUND OF THE INVENTION

1. Field of the Invention

The invention relates to a display; in particular, to a source driver applied to a display and an operating method thereof.

2. Description of the Prior Art

In general, most current liquid crystal displays use a driving method of column inversion cooperated with the panel structure design, so that even the output polarity of the source driver is column inversion, it looks like dot inversion on the panel.

As to the panel structure design, the Zigzag structure and the Pixel 3-5 (HSD2) structure are usually used in current liquid crystal panels. In addition, the output polarity inversion methods used in the output channels of the source driver can be 1V inversion, 2V inversion and (2V+1) inversion.

However, since there is no effective power saving method used for the current panel structure cooperated with the output way of the source driver, it is hard to reduce the power consumption of the liquid crystal display.

SUMMARY OF THE INVENTION

Therefore, the invention provides a source driver and an operating method thereof to solve the above-mentioned problems of the prior arts.

A preferred embodiment of the invention is a source driver. In this embodiment, the source driver includes output channels, a selection unit and a switching unit. The output channels are coupled to a panel. The output channels include M sets of output channels and each set of output channels includes 6N output channels. M and N are positive integers. The selection unit is used to select a lowest power consumption charge-sharing way from the charge-sharing ways corresponding to the 6N output channels with a timing controller algorithm. The switching unit is coupled to the selection unit and the 6N output channels and used to correspondingly switch the coupling relationships of the 6N output channels according to the lowest power consumption charge-sharing way. The lowest power consumption charge-sharing way is to randomly select K output channels from the 6N output channels to perform charge sharing, wherein K=0~6N.

In an embodiment, when N=1, the 6N output channels includes a first output channel, a second output channel, a third output channel, a fourth output channel, a fifth output channel and a sixth output channel. K=0~6. The charge-sharing ways include: (a) when K=0, no charge sharing is performed in the first output channel~the sixth output channel; (b) when K=1, one output channel is randomly selected from the first output channel~the sixth output channel to perform charge sharing; (c) when K=2, two output channels are randomly selected from the first output channel~the sixth output channel to perform charge sharing; (d) when K=3, three output channels are randomly selected from the first output channel~the sixth output channel to perform charge sharing; (e) when K=4, four output channels are randomly selected from the first output channel~the sixth output channel to perform charge sharing; (f) when K=5, five output channels are randomly selected from the first output channel~the sixth output channel to perform charge sharing; (g) when K=6, charge sharing is performed in all of the first output channel~the sixth output channel.

In an embodiment, when N=2, the 6N output channels includes a first output channel, a second output channel, a third output channel, a fourth output channel, a fifth output channel, a sixth output channel, a seventh output channel, an eighth output channel, a ninth output channel, a tenth output channel, an eleventh output channel and a twelfth output channel. K=0~12. The charge-sharing ways include: (a) when K=0, no charge sharing is performed in the first output channel~the twelfth output channel; (b) when K=1, one output channel is randomly selected from the first output channel~the twelfth output channel to perform charge sharing; (c) when K=2, two output channels are randomly selected from the first output channel~the twelfth output channel to perform charge sharing; (d) when K=3, three output channels are randomly selected from the first output channel~the twelfth output channel to perform charge sharing; (e) when K=4, four output channels are randomly selected from the first output channel~the twelfth output channel to perform charge sharing; (f) when K=5, five output channels are randomly selected from the first output channel~the twelfth output channel to perform charge sharing; (g) when K=6, six output channels are randomly selected from the first output channel~the twelfth output channel to perform charge sharing; (h) when K=7, seven output channels are randomly selected from the first output channel~the twelfth output channel to perform charge sharing; (i) when K=8, eight output channels are randomly selected from the first output channel~the twelfth output channel to perform charge sharing; (j) when K=9, nine output channels are randomly selected from the first output channel~the twelfth output channel to perform charge sharing; (k) when K=10, ten output channels are randomly selected from the first output channel~the twelfth output channel to perform charge sharing; (l) when K=11, eleven output channels are randomly selected from the first output channel~the twelfth output channel to perform charge sharing; (m) when K=12, charge sharing is performed in all of the first output channel~the twelfth output channel.

In an embodiment, each output channel of the output channels includes an operational amplifier, a first switch and a second switch. An input terminal and an output terminal of the operational amplifier are coupled. The first switch and the second switch are coupled to the output terminal of the operational amplifier respectively and the operation of the first switch and the second switch are controlled by the switching unit. The switching unit correspondingly controls the first switch and the second switch to be conducted or not according to the lowest power consumption charge-sharing way. The first switch and the second switch are not conducted at the same time.

In an embodiment, each output channel of the output channels includes an operational amplifier, a first switch, a second switch and a third switch. An input terminal and an output terminal of the operational amplifier are coupled. The first switch, the second switch and the third switch are coupled to the output terminal of the operational amplifier respectively and the operation of the first switch, the second switch and the third switch are controlled by the switching unit. The switching unit correspondingly controls the first switch, the second switch and the third switch to be conducted or not according to the lowest power consumption charge-sharing way.

Another preferred embodiment of the invention is a source driver operating method. In this embodiment, the source driver operating method is used to operate the source driver including output channels coupled to a panel. The output channels include M sets of output channels and each set of output channels includes 6N output channels. M and N are positive integers. The source driver operating method includes following steps: selecting a lowest power consumption charge-sharing way from the charge-sharing ways corresponding to the 6N output channels with a timing controller algorithm; and correspondingly switching the coupling relationships of the 6N output channels according to the lowest power consumption charge-sharing way. The lowest power consumption charge-sharing way is to randomly select K output channels from the 6N output channels to perform charge sharing, wherein K=0~6N.

Compared to the prior art, the source driver and operating method thereof in the invention cooperated with the timing controller algorithm to select a lowest power consumption charge-sharing way and corresponding switch the coupling relationships of the output channels of the source driver; therefore, no matter what the panel structure and the output polarity inversion method of the output channels of the source driver are, the source driver and operating method thereof in the invention can realize the charge sharing with the lowest power consumption to reduce power consumption of the liquid crystal display.

The advantage and spirit of the invention may be understood by the following detailed descriptions together with the appended drawings.

BRIEF DESCRIPTION OF THE APPENDED DRAWINGS

DETAILED DESCRIPTION OF THE INVENTION

A preferred embodiment of the invention is a source driver. In this embodiment, the source driver is applied to a liquid crystal display and coupled to a panel through its output channels.

In practical applications, the panel can have Zigzag structure or Pixel 3-5 (HSD2) structure, but not limited to this; the output polarity inversion method can be 1V inversion, 2V inversion or (2V+1) inversion, but not limited to this.

Figure 1:
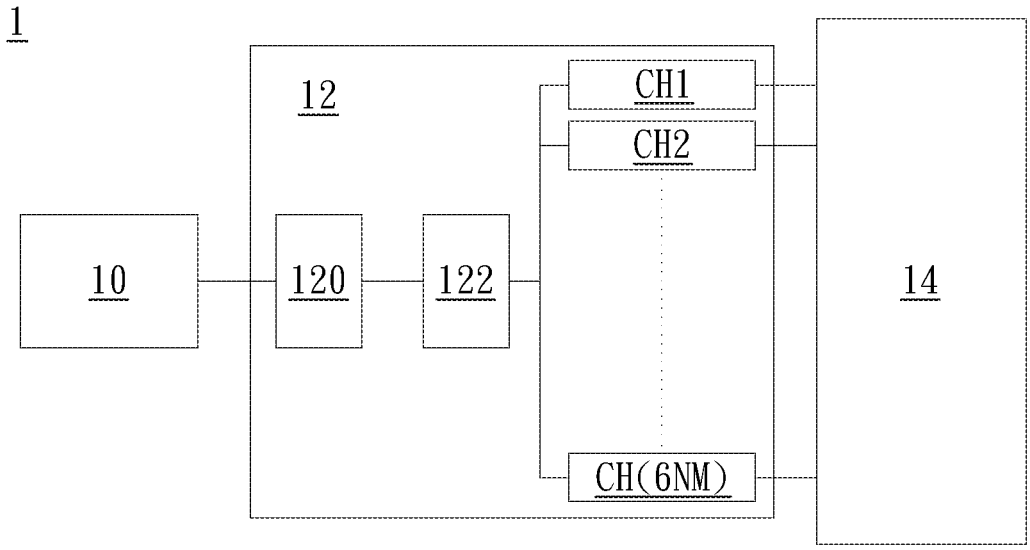
FIG. 1 illustrates a schematic diagram of the source driver in an embodiment of the invention.

Please refer to FIG. 1. FIG. 1 illustrates a schematic diagram of the source driver in this embodiment. As shown in FIG. 1, in a display 1, a source driver 12 is coupled between a timing controller 10 and a panel 14. The source driver 12 includes a selection unit 120, a switching unit 122 and a plurality of output channels CH1~CH(6NM). Wherein, N and M are positive integers. The selection unit 120 is coupled to the timing controller 10; the switching unit 122 is coupled to the selection unit 120 and the plurality of output channels CH1~CH(6NM); the plurality of output channels CH1~CH(6NM) is coupled to the panel 14.

Figure 2:
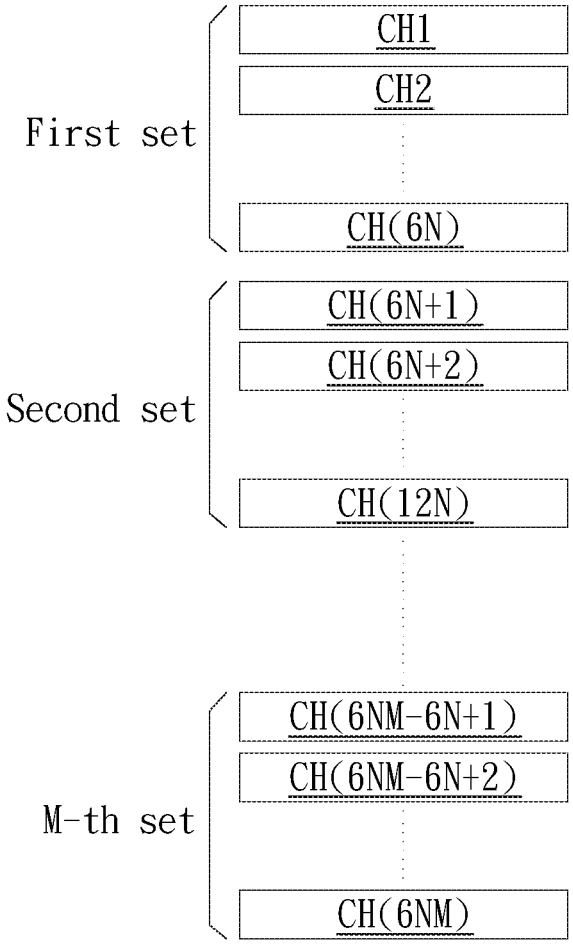
FIG. 2 illustrates a schematic diagram of the output channels of the source driver in FIG. 1 being divided into M sets of output channels and each set of output channels including 6N output channels.

It should be noticed that the plurality of output channels CH1~CH(6NM) of the source driver 12 in FIG. 1 can be divided into M sets of output channels and each set of output channels includes 6N output channels, wherein M and N are positive integers. That is to say, as shown in FIG. 2, if the 6NM output channels CH1~CH(6NM) are divided into M sets of output channels, then a first set of output channels will include the output channels CH1~CH(6N), a second set of output channels will include the output channels CH(6N+1)~CH(12N), . . . , a M-th set of output channels will include the output channels CH(6NM−6N+1)~CH(6NM).

Figure 3:
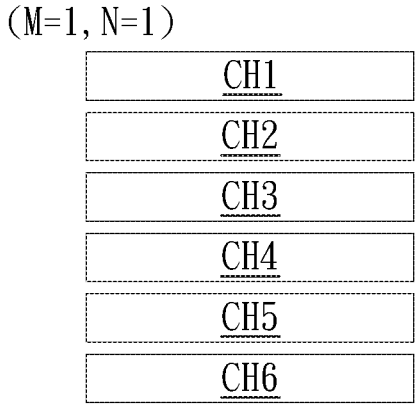
FIG. 3 illustrates a schematic diagram of the source driver including the first output channel CH1~the sixth output channel CH6 in an embodiment (M=1, N=1).
Figure 4:
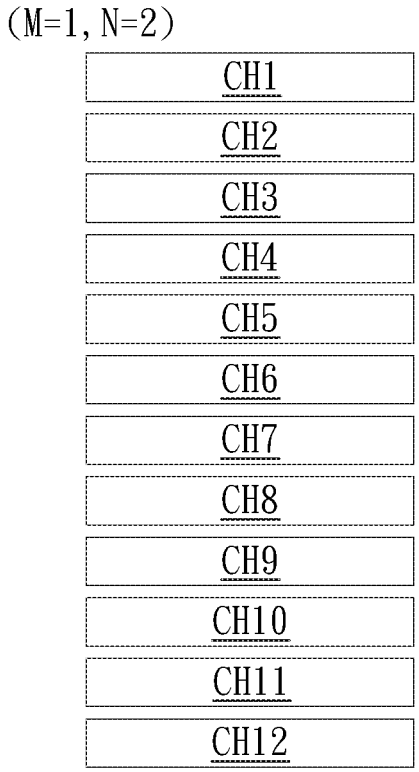
FIG. 4 illustrates a schematic diagram of the source driver including the first output channel CH1~the twelfth output channel CH12 in an embodiment (M=1, N=2).

For example, as shown in FIG. 3, if M=1 and N=1, then the source driver 12 includes a first output channel CH1, a second output channel CH2, a third output channel CH3, a fourth output channel CH4, a fifth output channel CH5 and a sixth output channel CH6; as shown in FIG. 4, if M=1 and N=2, then the source driver 12 includes a first output channel CH1, a second output channel CH2, a third output channel CH3, a fourth output channel CH4, a fifth output channel CH5, a sixth output channel CH6, a seventh output channel CH7, an eighth output channel CH8, a ninth output channel CH9, a tenth output channel CH10, an eleventh output channel CH11 and a twelfth output channel CH12. The rest can be deduced by analogy and will not be described here.

In this embodiment, the selection unit 120 can select a lowest power consumption charge-sharing way from a plurality of charge-sharing ways corresponding to the 6N output channels cooperated with an algorithm of the timing controller 10. That is to say, the selection unit 120 selects a charge-sharing way consuming the least energy (the lowest power consumption) from the plurality of charge-sharing ways cooperated with the algorithm of the timing controller 10. And then, the switching unit 122 correspondingly switches the coupling relationships of the 6N output channels according to the lowest power consumption charge-sharing way.

In practical applications, the lowest power consumption charge-sharing way is to randomly select K output channels from the 6N output channels to perform charge sharing, wherein K=0~6N.

Taking FIG. 3 for example, the source driver 12 includes the first output channel CH1, the second output channel CH2, the third output channel CH3, the fourth output channel CH4, the fifth output channel CH5 and the sixth output channel CH6. Therefore, there will be 7 charge sharing ways corresponding to K=0~6 among the first output channel CH1~the sixth output channel CH6 as follows:

(a) when K=0, no charge sharing is performed in the first output channel~the sixth output channel;

(b) when K=1, one output channel is randomly selected from the first output channel~the sixth output channel to perform charge sharing;

(c) when K=2, two output channels are randomly selected from the first output channel~the sixth output channel to perform charge sharing;

(d) when K=3, three output channels are randomly selected from the first output channel~the sixth output channel to perform charge sharing;

(e) when K=4, four output channels are randomly selected from the first output channel~the sixth output channel to perform charge sharing;

(f) when K=5, five output channels are randomly selected from the first output channel~the sixth output channel to perform charge sharing;

(g) when K=6, charge sharing is performed in all of the first output channel~the sixth output channel.

If the selection unit 120 selects the charge-sharing way (c) from the seven charge-sharing ways (a)~(g) as the lowest power consumption charge-sharing way, that is to say, the selection unit 120 determines that the charge-sharing way (c) consuming the least energy (the lowest power consumption) among the seven charge-sharing ways (a)~(g) cooperated with the algorithm of the timing controller 10, and then the switching unit 122 will correspondingly switch the coupling relationships of the first output channel~the sixth output channel according to the lowest power consumption charge-sharing way (c) to randomly select two output channels from the first output channel~the sixth output channel to perform charge sharing, so that the power consumption can be effectively reduced. The rest can be deduced by analogy and will not be described here.

Taking FIG. 4 for example, the source driver 12 includes a first output channel CH1, a second output channel CH2, a third output channel CH3, a fourth output channel CH4, a fifth output channel CH5 and a sixth output channel CH6; as shown in FIG. 4, if M=1 and N=2, then the source driver 12 includes a first output channel CH1, a second output channel CH2, a third output channel CH3, a fourth output channel CH4, a fifth output channel CH5, a sixth output channel CH6, a seventh output channel CH7, an eighth output channel CH8, a ninth output channel CH9, a tenth output channel CH10, an eleventh output channel CH11 and a twelfth output channel CH12. Therefore, there will be 13 charge sharing ways corresponding to K=0~12 among the first output channel CH1~the twelfth output channel CH12 as follows:

(a) when K=0, no charge sharing is performed in the first output channel~the twelfth output channel;

(b) when K=1, one output channel is randomly selected from the first output channel~the twelfth output channel to perform charge sharing;

(c) when K=2, two output channels are randomly selected from the first output channel~the twelfth output channel to perform charge sharing;

(d) when K=3, three output channels are randomly selected from the first output channel~the twelfth output channel to perform charge sharing;

(e) when K=4, four output channels are randomly selected from the first output channel~the twelfth output channel to perform charge sharing;

(f) when K=5, five output channels are randomly selected from the first output channel~the twelfth output channel to perform charge sharing;

(g) when K=6, six output channels are randomly selected from the first output channel~the twelfth output channel to perform charge sharing;

(h) when K=7, seven output channels are randomly selected from the first output channel~the twelfth output channel to perform charge sharing;

(i) when K=8, eight output channels are randomly selected from the first output channel~the twelfth output channel to perform charge sharing;

(j) when K=9, nine output channels are randomly selected from the first output channel~the twelfth output channel to perform charge sharing;

(k) when K=10, ten output channels are randomly selected from the first output channel~the twelfth output channel to perform charge sharing;

(l) when K=11, eleven output channels are randomly selected from the first output channel~the twelfth output channel to perform charge sharing;

(m) when K=12, charge sharing is performed in all of the first output channel~the twelfth output channel.

If the selection unit 120 selects the charge-sharing way (d) from the thirteen charge-sharing ways (a)~(m) as the lowest power consumption charge-sharing way, that is to say, the selection unit 120 determines that the charge-sharing way (d) consuming the least energy (the lowest power consumption) among the thirteen charge-sharing ways (a)~(m) cooperated with the algorithm of the timing controller 10, and then the switching unit 122 will correspondingly switch the coupling relationships of the first output channel~the twelfth output channel according to the lowest power consumption charge-sharing way (d) to randomly select three output channels from the first output channel~the twelfth output channel to perform charge sharing, so that the power consumption can be effectively reduced. The rest can be deduced by analogy and will not be described here.

Figure 5A:
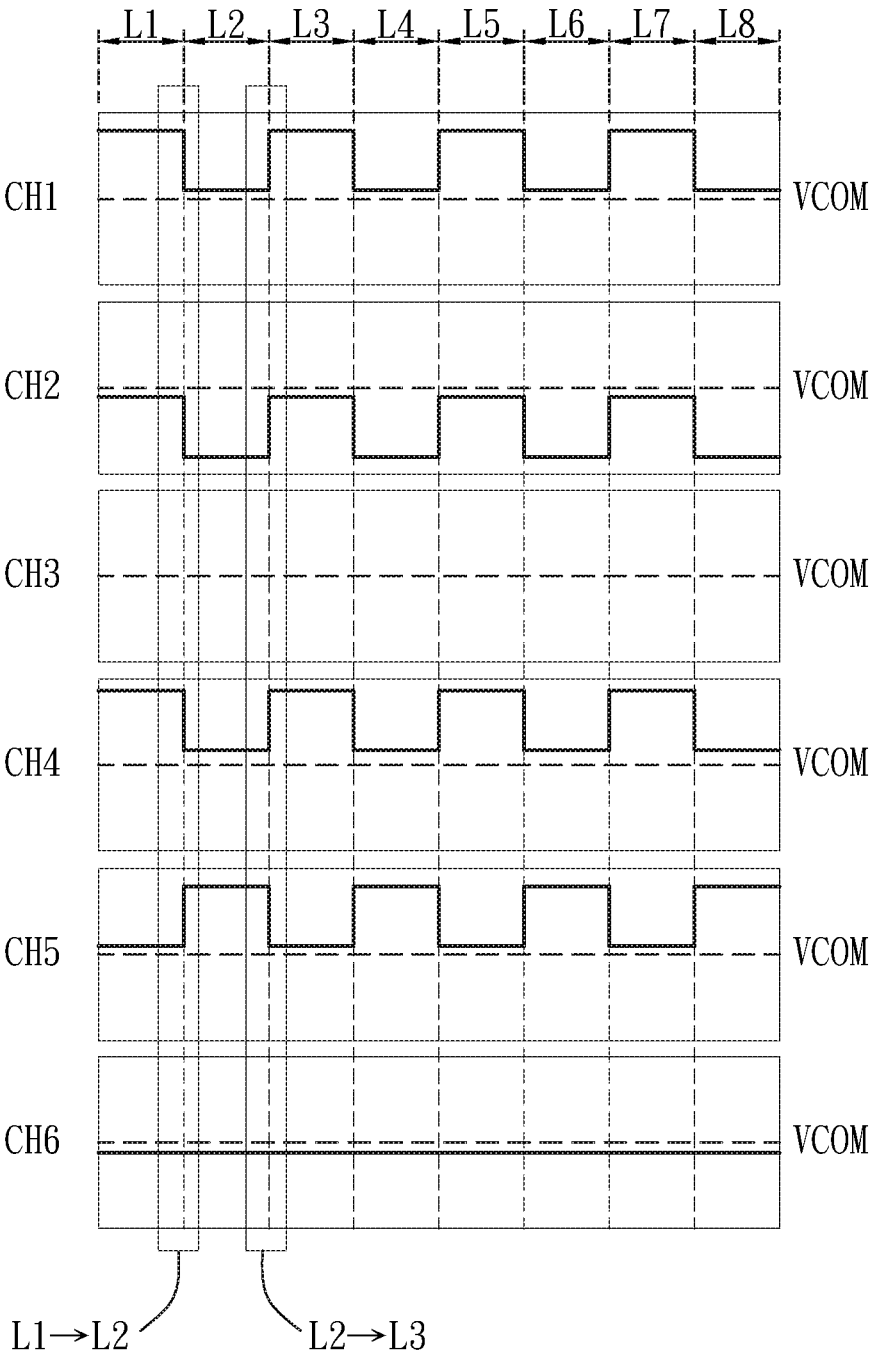
FIG. 5A and FIG. 5B illustrate schematic diagrams of the voltage levels of the data signals outputted by the first output channel CH1~the twelfth output channel CH12 of the source driver using the output polarity inversion method of (2V+1) inversion when the panel with Zigzag structure displays a single color (e.g., red).
Figure 5B:
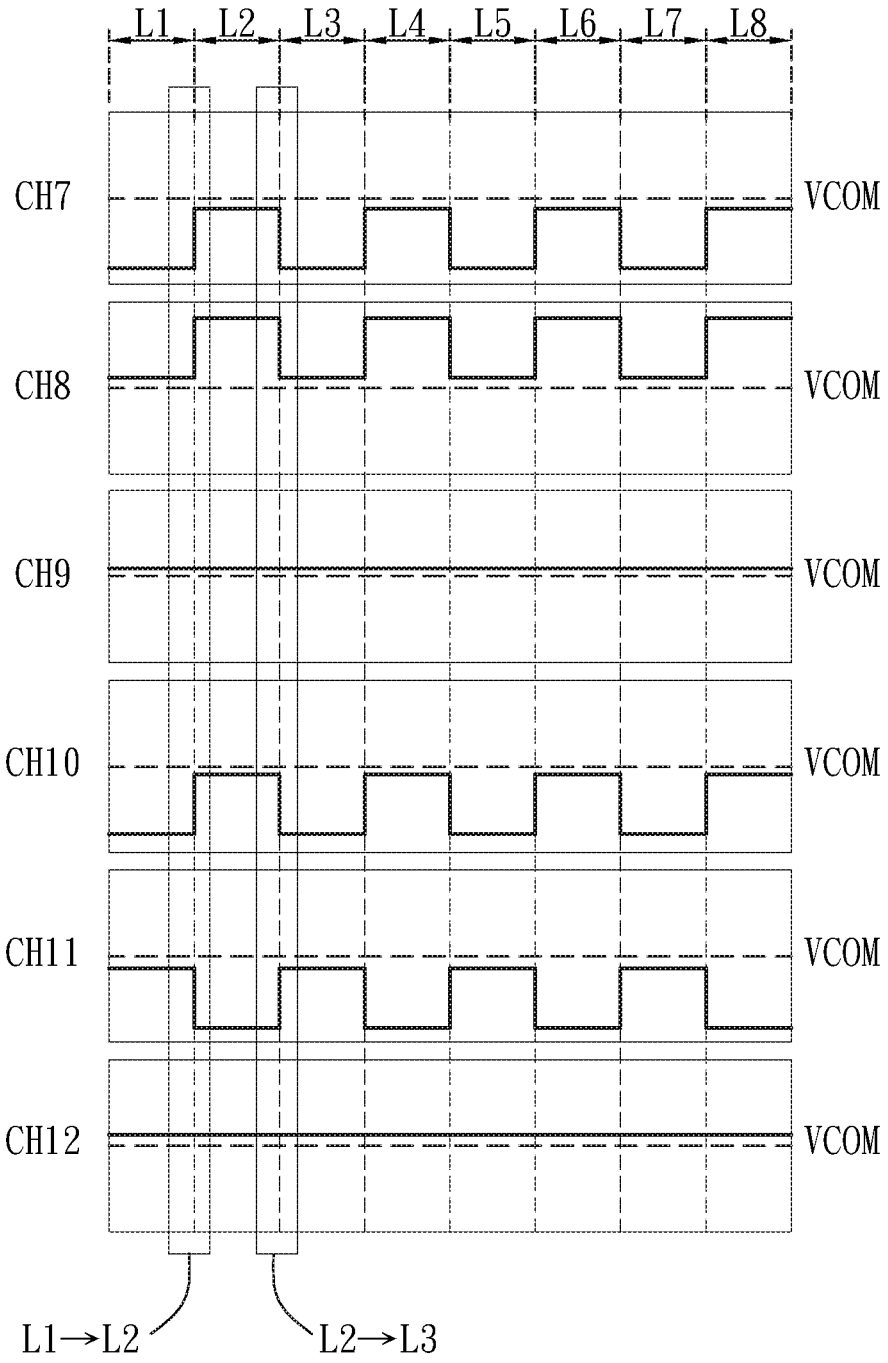

Then, please refer to FIG. 5A and FIG. 5B. FIG. 5A and FIG. 5B illustrate schematic diagrams of the voltage levels of the data signals outputted by the first output channel CH1~the twelfth output channel CH12 of the source driver 12 using the output polarity inversion method of (2V+1) inversion when the panel 14 with Zigzag structure displays a single color (e.g., red).

As shown in FIG. 5A and FIG. 5B, since the first output channel CH1~the twelfth output channel CH12 of the source driver 12 use the output polarity inversion method of (2V+1) inversion, the output polarities of the first output channel CH1, the second output channel CH2, the third output channel CH3, the fourth output channel CH4, the fifth output channel CH5, the sixth output channel CH6, the seventh output channel CH7, the eighth output channel CH8, the ninth output channel CH9, the tenth output channel CH10, the eleventh output channel CH11 and the twelfth output channel CH12 are positive (+), negative (−), negative (−), positive (+), positive (+), negative (−), negative (−), positive (+), positive (+), negative (−), negative (−) and positive (+) in order.

As shown in FIG. 5A and FIG. 5B, when the output polarity of the output channels is positive (+), the voltage levels of the data signals outputted by the output channels are all higher than the common voltage VCOM; on the contrary, when the output polarity of the output channels is negative (−), the voltage levels of the data signals outputted by the output channels are all lower than the common voltage VCOM.

Figure 6A:
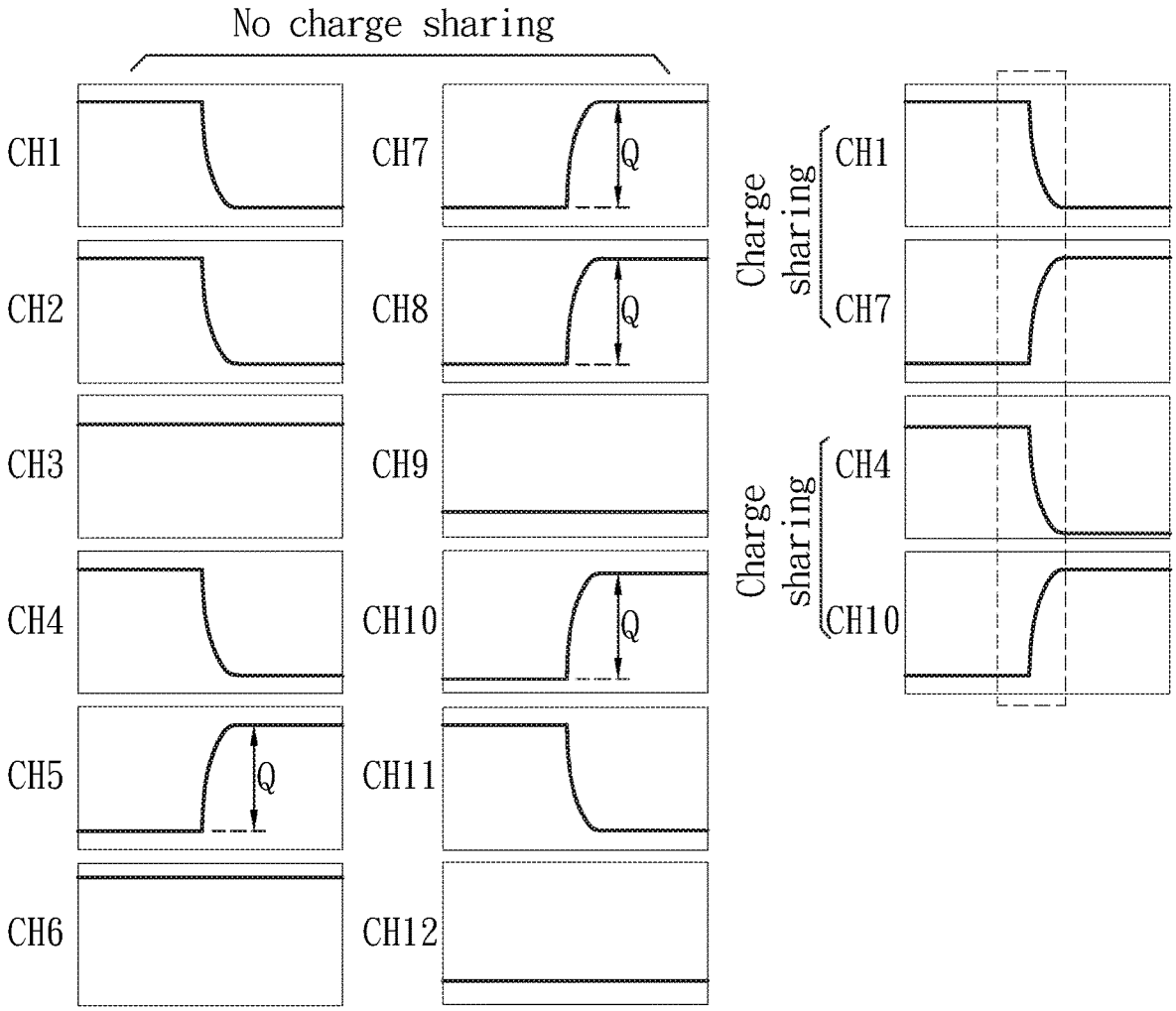
FIG. 6A illustrates a schematic diagram of using the lowest power consumption charge-sharing way to perform charge sharing to reduce power consumption when the data signal is transmitted from the first data line L1 of the panel to the second data line L2.

Please refer to FIG. 5A, FIG. 5B and the first output channel CH1~the twelfth output channel CH12 without charge sharing shown in the left-side of FIG. 6A. As to the first output channel CH1, when the positive (+) data signal outputted by the first output channel CH1 is transmitted from a first data line L1 of the panel to a second data line L2, the positive (+) data signal is changed from high-level to low-level.

As to the second output channel CH2, when the negative (−) data signal outputted by the second output channel CH2 is transmitted from the first data line L1 of the panel to the second data line L2, the negative (−) data signal is changed from high-level to low-level.

As to the third output channel CH3, when the negative (−) data signal outputted by the third output channel CH3 is transmitted from the first data line L1 of the panel to the second data line L2, the negative (−) data signal is maintained at high-level.

As to the fourth output channel CH4, when the positive (+) data signal outputted by the fourth output channel CH4 is transmitted from the first data line L1 of the panel to the second data line L2, the positive (+) data signal is changed from high-level to low-level.

As to the fifth output channel CH5, when the positive (+) data signal outputted by the fifth output channel CH5 is transmitted from the first data line L1 of the panel to the second data line L2, the positive (+) data signal is changed from low-level to high-level. It should be noticed that the fifth channel CH5 needs to consume energy (power consumption) Q at this time.

As to the sixth output channel CH6, when the negative (−) data signal outputted by the sixth output channel CH6 is transmitted from the first data line L1 of the panel to the second data line L2, the negative (−) data signal is maintained at high-level.

As to the seventh output channel CH7, when the negative (−) data signal outputted by the seventh output channel CH7 is transmitted from the first data line L1 of the panel to the second data line L2, the negative (−) data signal is changed from low-level to high-level. It should be noticed that the seventh channel CH7 needs to consume energy (power consumption) Q at this time.

As to the eighth output channel CH8, when the positive (+) data signal outputted by the eighth output channel CH8 is transmitted from the first data line L1 of the panel to the second data line L2, the positive (+) data signal is changed from low-level to high-level. It should be noticed that the eighth channel CH8 needs to consume energy (power consumption) Q at this time.

As to the ninth output channel CH9, when the positive (+) data signal outputted by the ninth output channel CH9 is transmitted from the first data line L1 of the panel to the second data line L2, the positive (+) data signal is maintained at low-level.

As to the tenth output channel CH10, when the negative (−) data signal outputted by the tenth output channel CH10 is transmitted from the first data line L1 of the panel to the second data line L2, the negative (−) data signal is changed from low-level to high-level. It should be noticed that the tenth channel CH10 needs to consume energy (power consumption) Q at this time.

As to the eleventh output channel CH11, when the negative (−) data signal outputted by the eleventh output channel CH11 is transmitted from the first data line L1 of the panel to the second data line L2, the negative (−) data signal is changed from high-level to low-level.

As to the twelfth output channel CH12, when the positive (+) data signal outputted by the twelfth output channel CH12 is transmitted from the first data line L1 of the panel to the second data line L2, the positive (+) data signal is maintained at low-level.

Above all, if no charge sharing is performed in the first output channel CH1~the twelfth output channel CH12, total energy consumed (power consumption) is 4Q when the data signals outputted by the first output channel CH1~the twelfth output channel CH12 are transmitted from the first data line L1 of the panel to the second data line L2.

When the data signals are transmitted from the first data line L1 of the panel to the second data line L2, as shown in the right-side of the FIG. 6A, the lowest power consumption charge-sharing way selected by the selection unit 120 of the invention from all charge-sharing ways can be: performing charge sharing on the first output channel CH1 of positive (+) output and the seventh output channel CH7 of negative output (−) and performing charge sharing on the fourth output channel CH4 of positive (+) output and the tenth output channel CH10 of negative output (−). Therefore, the switching unit 122 will correspondingly switch the first output channel CH1 and the seventh output channel CH7 to be coupled and switch the fourth output channel CH4 and the tenth output channel CH10 to be coupled according to the lowest power consumption charge-sharing way.

Since the first output channel CH1 is changed from high-level to low-level and the seventh output channel CH7 is changed from low-level to high-level, when they are coupled to perform charge sharing, the voltage changes of the first output channel CH1 and the seventh output channel CH7 will be compensated without power consumption. Similarly, Since the fourth output channel CH4 is changed from high-level to low-level and the tenth output channel CH10 is changed from low-level to high-level, when they are coupled to perform charge sharing, the voltage changes of the fourth output channel CH4 and the tenth output channel CH10 will be compensated without power consumption. Therefore, the total energy consumed (power consumption) is 2Q including the energy consumed by the fifth output channel CH5 and the eighth output channel CH8 when the data signals outputted by the first output channel CH1~the twelfth output channel CH12 are transmitted from the first data line L1 of the panel to the second data line L2. That is to say, using the lowest power consumption charge-sharing way can effectively reduce 50% power consumption.

Figure 6B:
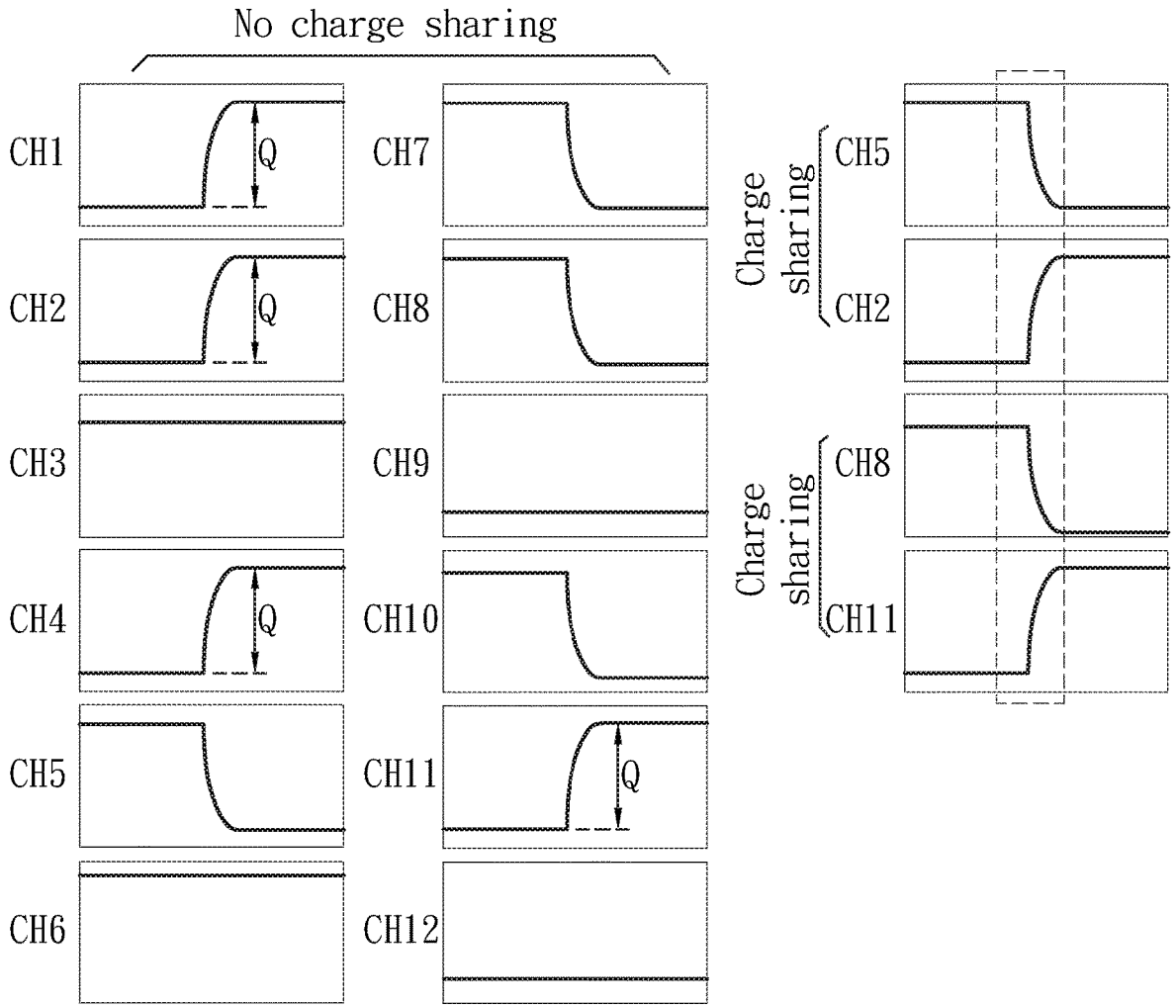
FIG. 6B illustrates a schematic diagram of using the lowest power consumption charge-sharing way to perform charge sharing to reduce power consumption when the data signal is transmitted from the second data line L2 of the panel to the third data line L3.

Similarly, please refer to FIG. 5A, FIG. 5B and the first output channel CH1~the twelfth output channel CH12 without charge sharing shown in the left-side of FIG. 6B. As to the first output channel CH1, when the positive (+) data signal outputted by the first output channel CH1 is transmitted from a second data line L2 of the panel to a third data line L3, the positive (+) data signal is changed from low-level to high-level. It should be noticed that the first channel CH1 needs to consume energy (power consumption) Q at this time.

As to the second output channel CH2, when the negative (−) data signal outputted by the second output channel CH2 is transmitted from the second data line L2 of the panel to the third data line L3, the negative (−) data signal is changed from low-level to high-level. It should be noticed that the second channel CH2 needs to consume energy (power consumption) Q at this time.

As to the third output channel CH3, when the negative (−) data signal outputted by the third output channel CH3 is transmitted from the second data line L2 of the panel to the third data line L3, the negative (−) data signal is maintained at high-level.

As to the fourth output channel CH4, when the positive (+) data signal outputted by the fourth output channel CH4 is transmitted from the second data line L2 of the panel to the third data line L3, the positive (+) data signal is changed from low-level to high-level. It should be noticed that the fourth output channel CH4 needs to consume energy (power consumption) Q at this time.

As to the fifth output channel CH5, when the positive (+) data signal outputted by the fifth output channel CH5 is transmitted from the second data line L2 of the panel to the third data line L3, the positive (+) data signal is changed from high-level to low-level.

As to the sixth output channel CH6, when the negative (−) data signal outputted by the sixth output channel CH6 is transmitted from the second data line L2 of the panel to the third data line L3, the negative (−) data signal is maintained at high-level.

As to the seventh output channel CH7, when the negative (−) data signal outputted by the seventh output channel CH7 is transmitted from the second data line L2 of the panel to the third data line L3, the negative (−) data signal is changed from high-level to low-level.

As to the eighth output channel CH8, when the positive (+) data signal outputted by the eighth output channel CH8 is transmitted from the second data line L2 of the panel to the third data line L3, the positive (+) data signal is changed from high-level to low-level.

As to the ninth output channel CH9, when the positive (+) data signal outputted by the ninth output channel CH9 is transmitted from the second data line L2 of the panel to the third data line L3, the positive (+) data signal is maintained at low-level.

As to the tenth output channel CH10, when the negative (−) data signal outputted by the tenth output channel CH10 is transmitted from the second data line L2 of the panel to the third data line L3, the negative (−) data signal is changed from high-level to low-level.

As to the eleventh output channel CH11, when the negative (−) data signal outputted by the eleventh output channel CH11 is transmitted from the second data line L2 of the panel to the third data line L3, the negative (−) data signal is changed from low-level to high-level. It should be noticed that the eleventh output channel CH11 needs to consume energy (power consumption) Q at this time.

As to the twelfth output channel CH12, when the positive (+) data signal outputted by the twelfth output channel CH12 is transmitted from the second data line L2 of the panel to the third data line L3, the positive (+) data signal is maintained at low-level.

Above all, if no charge sharing is performed in the first output channel CH1~the twelfth output channel CH12, total energy consumed (power consumption) is 4Q when the data signals outputted by the first output channel CH1~the twelfth output channel CH12 are transmitted from the second data line L2 of the panel to the third data line L3.

When the data signals are transmitted from the second data line L2 of the panel to the third data line L3, as shown in the right-side of the FIG. 6B, the lowest power consumption charge-sharing way selected by the selection unit 120 of the invention from all charge-sharing ways can be: performing charge sharing on the fifth output channel CH5 of positive (+) output and the second output channel CH2 of negative output (−) and performing charge sharing on the eighth output channel CH8 of positive (+) output and the eleventh output channel CH11 of negative output (−). Therefore, the switching unit 122 will correspondingly switch the fifth output channel CH5 and the second output channel CH2 to be coupled and switch the eighth output channel CH8 and the eleventh output channel CH11 to be coupled according to the lowest power consumption charge-sharing way.

Since the fifth output channel CH5 is changed from high-level to low-level and the second output channel CH2 is changed from low-level to high-level, when they are coupled to perform charge sharing, the voltage changes of the fifth output channel CH5 and the second output channel CH2 will be compensated without power consumption. Similarly, since the eighth output channel CH8 is changed from high-level to low-level and the eleventh output channel CH11 is changed from low-level to high-level, when they are coupled to perform charge sharing, the voltage changes of the eighth output channel CH8 and the eleventh output channel CH11 will be compensated without power consumption. Therefore, the total energy consumed (power consumption) is 2Q including the energy consumed by the first output channel CH1 and the fourth output channel CH4 when the data signals outputted by the first output channel CH1~the twelfth output channel CH12 are transmitted from the second data line L2 of the panel to the third data line L3. That is to say, using the lowest power consumption charge-sharing way can effectively reduce 50% power consumption.

It should be noticed that the lowest power consumption charge-sharing way selected by the selection unit 120 cooperated with the timing controller 10 is not limited by the above-mentioned embodiments.

Figure 7:
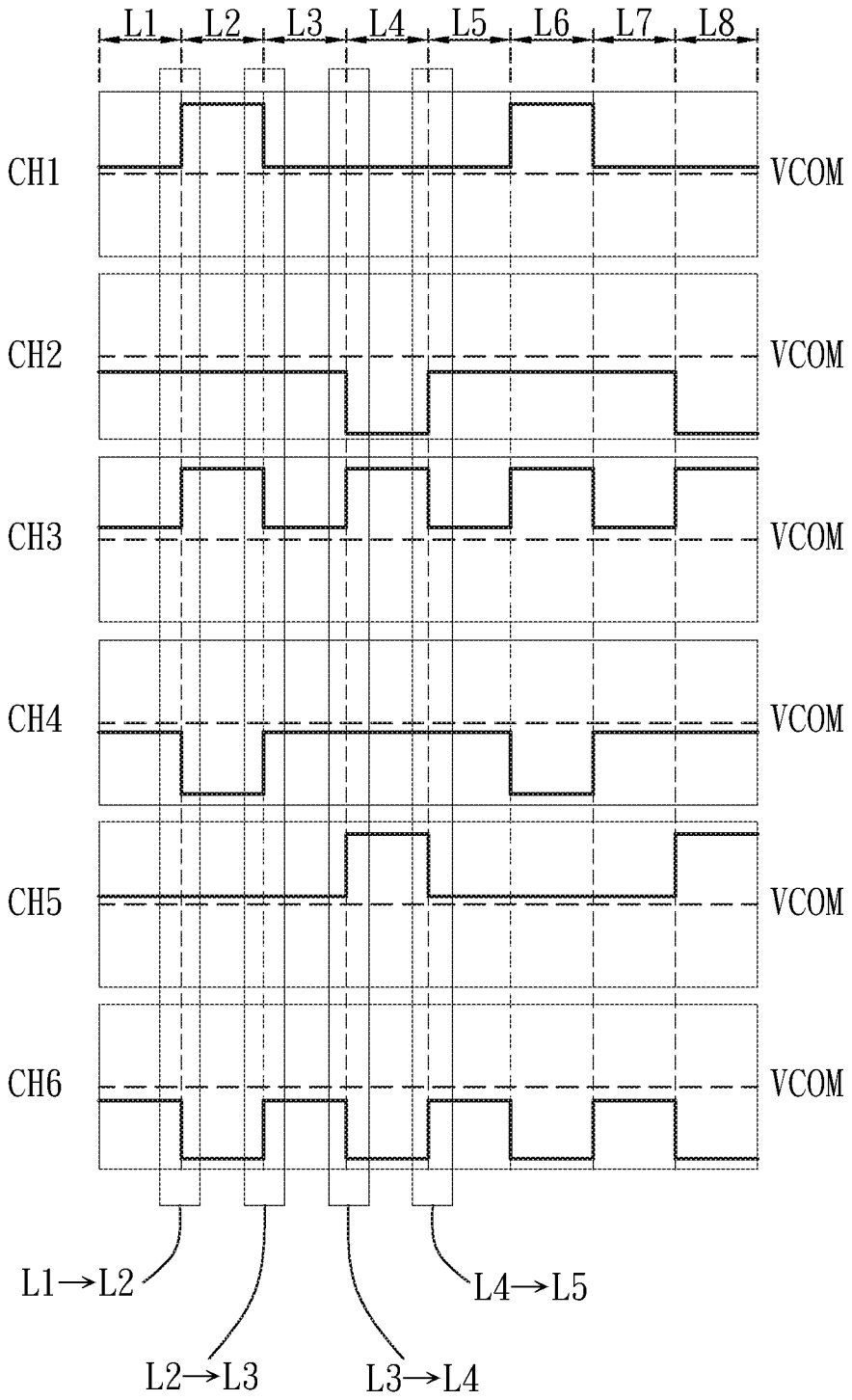
FIG. 7 illustrates a schematic diagram of the voltage levels of the data signals outputted by the first output channel CH1~the sixth output channel CH6 of the source driver using the output polarity inversion method of iv inversion when the panel with Pixel 2-5 structure displays a single color (e.g., red).

In another embodiment, please refer to FIG. 7. FIG. 7 illustrates a schematic diagram of the voltage levels of the data signals outputted by the first output channel CH1~the sixth output channel CH6 of the source driver 12 using the output polarity inversion method of 1V inversion when the panel 14 with Pixel 2-5 structure displays a single color (e.g., red).

As shown in FIG. 7, since the first output channel CH1~the sixth output channel CH6 of the source driver 12 use the output polarity inversion method of 1V inversion, the output polarities of the first output channel CH1, the second output channel CH2, the third output channel CH3, the fourth output channel CH4, the fifth output channel CH5 and the sixth output channel CH6 are positive (+), negative (−), positive (+), negative (−), positive (+) and negative (−) in order.

As shown in FIG. 7, when the output polarity of the output channels is positive (+), the voltage levels of the data signals outputted by the output channels are all higher than the common voltage VCOM; on the contrary, when the output polarity of the output channels is negative (−), the voltage levels of the data signals outputted by the output channels are all lower than the common voltage VCOM.

It should be noticed that L1→L2 in FIG. 7 represents that the data signal is transmitted from the first data line L1 to the second data line L2, L2→L3 in FIG. 7 represents that the data signal is transmitted from the second data line L2 to the third data line L3, L3→L4 in FIG. 7 represents that the data signal is transmitted from the third data line L3 to the fourth data line L4, and L4→L5 in FIG. 7 represents that the data signal is transmitted from the fourth data line L4 to the fifth data line L5, wherein examples of L2→L3 and L4→L5 will be introduced as follows and so on.

Figure 8A:
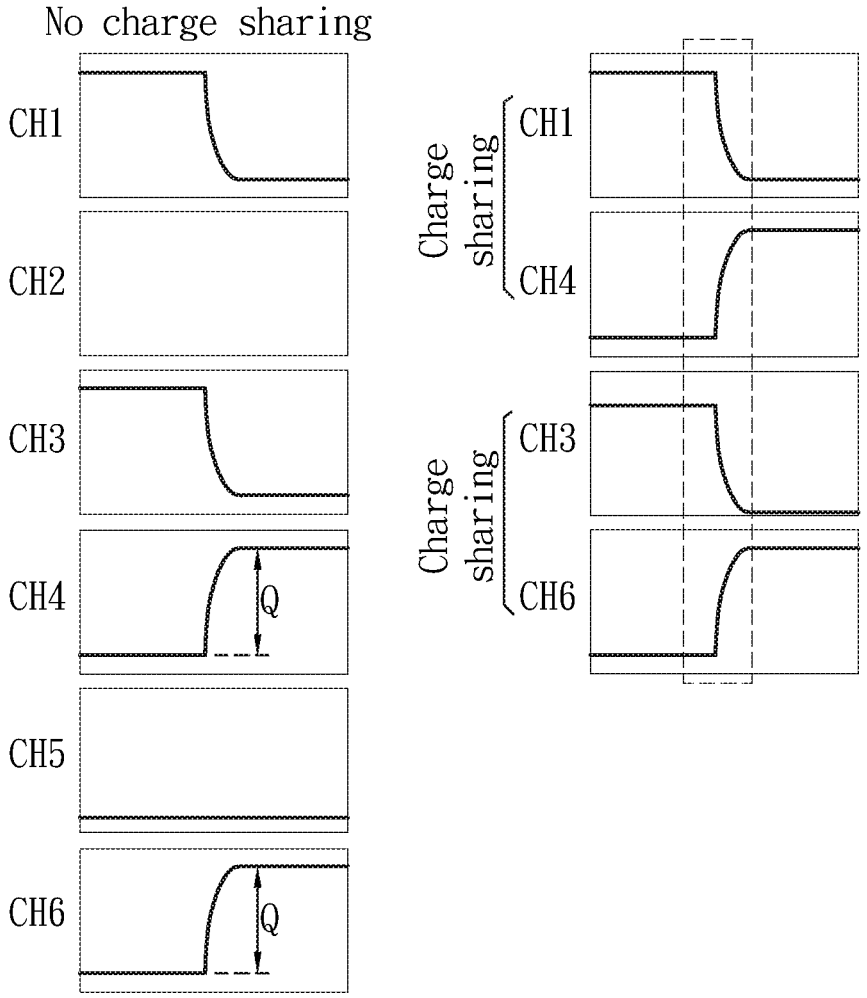
FIG. 8A illustrates a schematic diagram of using the lowest power consumption charge-sharing way to perform charge sharing to reduce power consumption when the data signal is transmitted from the second data line L2 of the panel to the third data line L3.

Please refer to FIG. 7 and the first output channel CH1~the sixth output channel CH6 without charge sharing shown in the left-side of FIG. 8A. As to the first output channel CH1, when the positive (+) data signal outputted by the first output channel CH1 is transmitted from the second data line L2 of the panel to the third data line L3, the positive (+) data signal is changed from high-level to low-level.

As to the second output channel CH2, when the negative (−) data signal outputted by the second output channel CH2 is transmitted from the second data line L2 of the panel to the third data line L3, the negative (−) data signal is maintained at high-level.

As to the third output channel CH3, when the positive (+) data signal outputted by the third output channel CH3 is transmitted from the second data line L2 of the panel to the third data line L3, the positive (+) data signal is changed from high-level to low-level.

As to the fourth output channel CH4, when the negative (−) data signal outputted by the fourth output channel CH4 is transmitted from the second data line L2 of the panel to the third data line L3, the negative (−) data signal is changed from low-level to high-level. It should be noticed that the fourth output channel CH4 needs to consume energy (power consumption) Q at this time.

As to the fifth output channel CH5, when the positive (+) data signal outputted by the fifth output channel CH5 is transmitted from the second data line L2 of the panel to the third data line L3, the positive (+) data signal is maintained at low-level.

As to the sixth output channel CH6, when the negative (−) data signal outputted by the sixth output channel CH6 is transmitted from the second data line L2 of the panel to the third data line L3, the negative (−) data signal is changed from low-level to high-level. It should be noticed that the sixth output channel CH6 needs to consume energy (power consumption) Q at this time.

Above all, if no charge sharing is performed in the first output channel CH1~the sixth output channel CH6, total energy consumed (power consumption) is 2Q when the data signals outputted by the first output channel CH1~the sixth output channel CH6 are transmitted from the second data line L2 of the panel to the third data line L3.

When the data signals are transmitted from the second data line L2 of the panel to the third data line L3, as shown in the right-side of the FIG. 8A, the lowest power consumption charge-sharing way selected by the selection unit 120 of the invention from all charge-sharing ways can be: performing charge sharing on the first output channel CH1 of positive (+) output and the fourth output channel CH4 of negative output (−) and performing charge sharing on the third output channel CH3 of positive (+) output and the sixth output channel CH6 of negative output (−). Therefore, the switching unit 122 will correspondingly switch the first output channel CH1 and the fourth output channel CH4 to be coupled and switch the third output channel CH3 and the sixth output channel CH6 to be coupled according to the lowest power consumption charge-sharing way.

Since the first output channel CH1 is changed from high-level to low-level and the fourth output channel CH4 is changed from low-level to high-level, when they are coupled to perform charge sharing, the voltage changes of the first output channel CH1 and the fourth output channel CH4 will be compensated without power consumption. Similarly, since the third output channel CH3 is changed from high-level to low-level and the sixth output channel CH6 is changed from low-level to high-level, when they are coupled to perform charge sharing, the voltage changes of the third output channel CH3 and the sixth output channel CH6 will be compensated without power consumption. Therefore, the total energy consumed (power consumption) is zero when the data signals outputted by the first output channel CH1~the sixth output channel CH6 are transmitted from the second data line L2 of the panel to the third data line L3. That is to say, using the lowest power consumption charge-sharing way can effectively reduce power consumption.

Figure 8B:
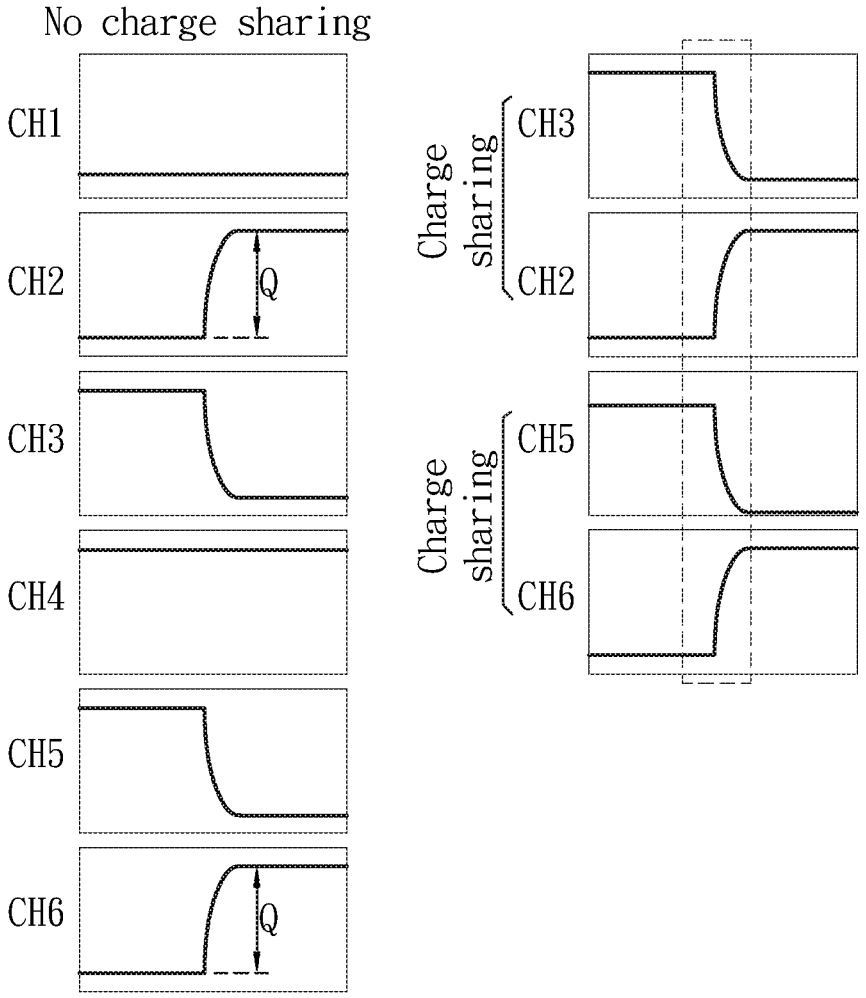
FIG. 8B illustrates a schematic diagram of using the lowest power consumption charge-sharing way to perform charge sharing to reduce power consumption when the data signal is transmitted from the fourth data line L4 of the panel to the fifth data line L5.

Similarly, please refer to FIG. 7 and the first output channel CH1~the sixth output channel CH6 without charge sharing shown in the left-side of FIG. 8B. As to the first output channel CH1, when the positive (+) data signal outputted by the first output channel CH1 is transmitted from the fourth data line L4 of the panel to the fifth data line L5, the positive (+) data signal is maintained at low-level.

As to the second output channel CH2, when the negative (−) data signal outputted by the second output channel CH2 is transmitted from the fourth data line L4 of the panel to the fifth data line L5, the negative (−) data signal is changed from low-level to high-level. It should be noticed that the second output channel CH2 needs to consume energy (power consumption) Q at this time.

As to the third output channel CH3, when the positive (+) data signal outputted by the third output channel CH3 is transmitted from the fourth data line L4 of the panel to the fifth data line L5, the positive (+) data signal is changed from high-level to low-level.

As to the fourth output channel CH4, when the negative (−) data signal outputted by the fourth output channel CH4 is transmitted from the fourth data line L4 of the panel to the fifth data line L5, the negative (−) data signal is maintained at high-level.

As to the fifth output channel CH5, when the positive (+) data signal outputted by the fifth output channel CH5 is transmitted from the fourth data line L4 of the panel to the fifth data line L5, the positive (+) data signal is changed from high-level to low-level.

As to the sixth output channel CH6, when the negative (−) data signal outputted by the sixth output channel CH6 is transmitted from the fourth data line L4 of the panel to the fifth data line L5, the negative (−) data signal is changed from low-level to high-level. It should be noticed that the sixth output channel CH6 needs to consume energy (power consumption) Q at this time.

Above all, if no charge sharing is performed in the first output channel CH1~the sixth output channel CH6, total energy consumed (power consumption) is 2Q when the data signals outputted by the first output channel CH1~the sixth output channel CH6 are transmitted from the fourth data line L4 of the panel to the fifth data line L5.

When the data signals are transmitted from the fourth data line L4 of the panel to the fifth data line L5, as shown in the right-side of the FIG. 8B, the lowest power consumption charge-sharing way selected by the selection unit 120 of the invention from all charge-sharing ways can be: performing charge sharing on the third output channel CH3 of positive (+) output and the second output channel CH2 of negative output (−) and performing charge sharing on the fifth output channel CH5 of positive (+) output and the sixth output channel CH6 of negative output (−). Therefore, the switching unit 122 will correspondingly switch the third output channel CH3 and the second output channel CH2 to be coupled and switch the fifth output channel CH5 and the sixth output channel CH6 to be coupled according to the lowest power consumption charge-sharing way.

Since the third output channel CH3 is changed from high-level to low-level and the second output channel CH2 is changed from low-level to high-level, when they are coupled to perform charge sharing, the voltage changes of the third output channel CH3 and the second output channel CH2 will be compensated without power consumption. Similarly, since the fifth output channel CH5 is changed from high-level to low-level and the sixth output channel CH6 is changed from low-level to high-level, when they are coupled to perform charge sharing, the voltage changes of the fifth output channel CH5 and the sixth output channel CH6 will be compensated without power consumption. Therefore, the total energy consumed (power consumption) is zero when the data signals outputted by the first output channel CH1~the sixth output channel CH6 are transmitted from the fourth data line L4 of the panel to the fifth data line L5. That is to say, using the lowest power consumption charge-sharing way can effectively reduce power consumption.

Figure 9A:
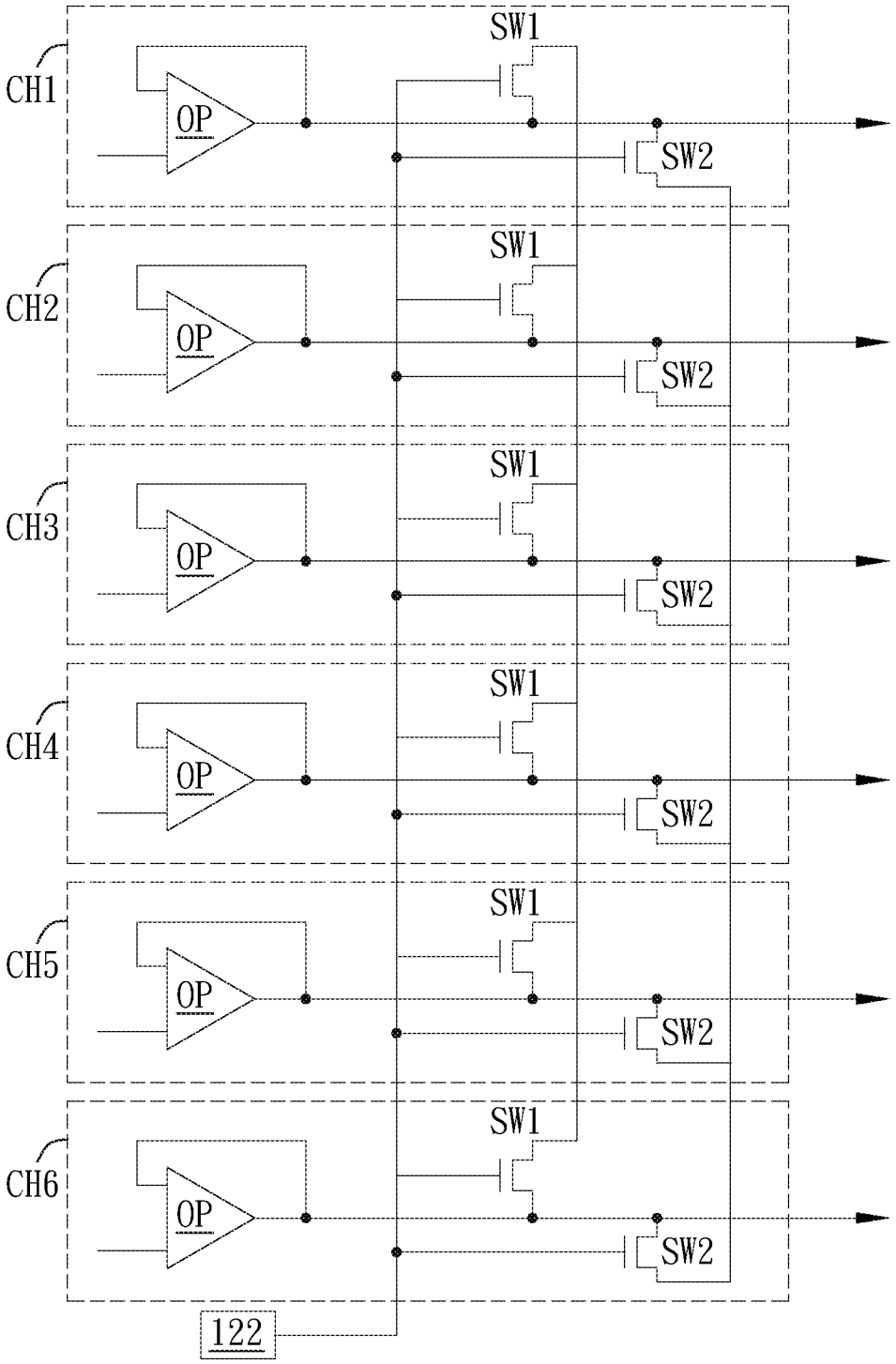
FIG. 9A illustrates a schematic diagram of each output channel of the first output channel CH1~the sixth output channel CH6 of the source driver including an operational amplifier, a first switch and a second switch.

Next, please refer to FIG. 9A. As shown in FIG. 9A, in an embodiment, as to the first output channel CH1~the sixth output channel CH6 of the source driver in FIG. 3, each of the first output channel CH1~the sixth output channel CH6 can include an operational amplifier OP, a first switch SW1 and a second switch SW2. One input terminal and an output terminal of the operational amplifier OP are coupled. The first switch SW1 and the second switch SW2 are coupled to the output terminal of the operational amplifier OP respectively. The operation of the first switch SW1 and the second switch SW2 are controlled by the switching unit 122. The switching unit 122 correspondingly controls whether the first switch SW1 and the second switch SW2 are conducted or not according to the lowest power consumption charge sharing way. It should be noticed that the first switch SW1 and the second switch SW2 are not conducted at the same time.

In addition, as to the first output channel CH1~the twelfth output channel CH12 in FIG. 4, each of the first output channel CH1~the twelfth output channel CH12 can also include an operational amplifier OP, a first switch SW1 and a second switch SW2, and so on.

Figure 9B:
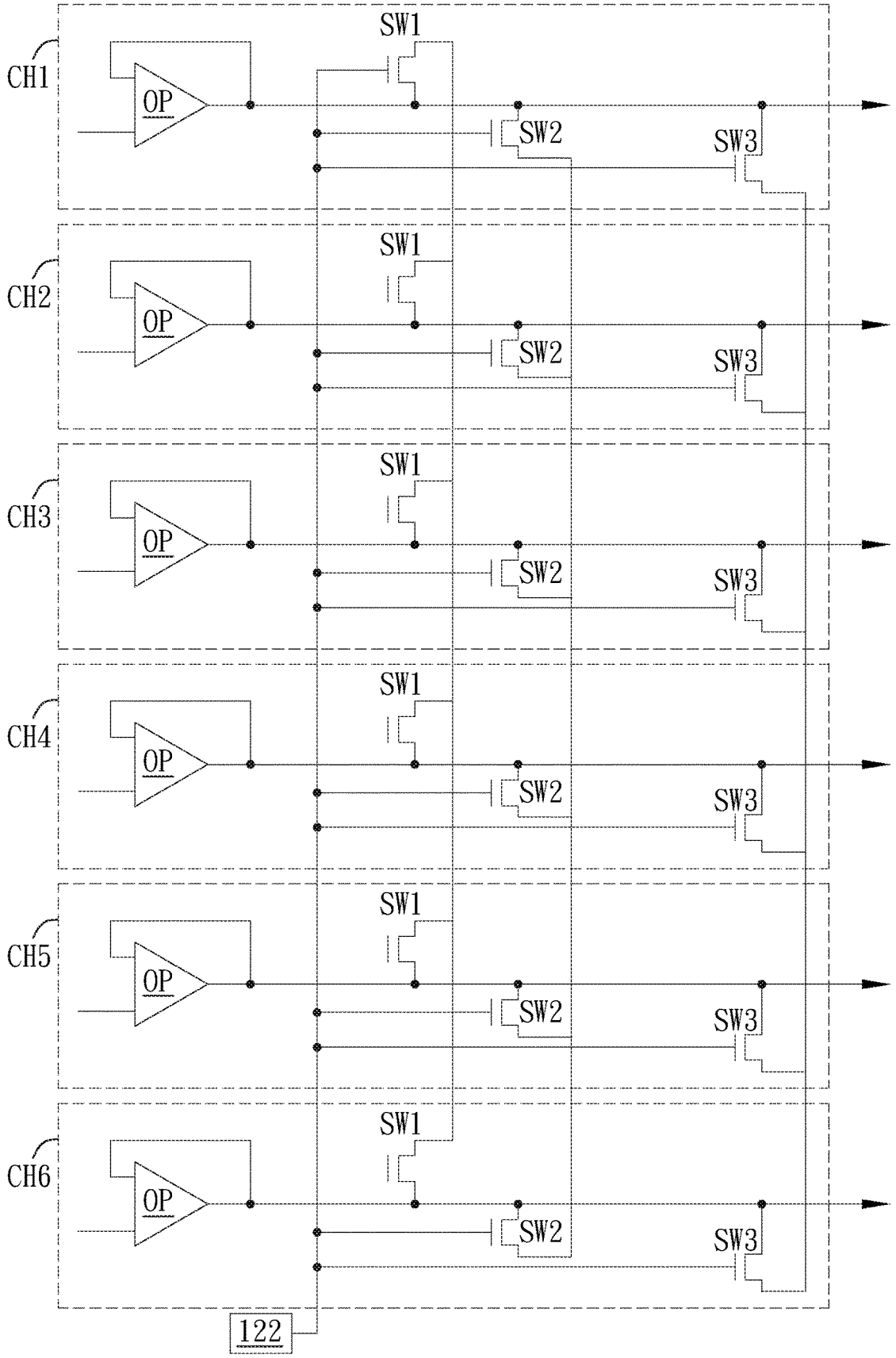
FIG. 9B illustrates a schematic diagram of each output channel of the first output channel CH1~the sixth output channel CH6 of the source driver including an operational amplifier, a first switch, a second switch and a third switch.

Then, please refer to FIG. 9B. As shown in FIG. 9B, in an embodiment, as to the first output channel CH1~the sixth output channel CH6 of the source driver in FIG. 3, each of the first output channel CH1~the sixth output channel CH6 can include an operational amplifier OP, a first switch SW1, a second switch SW2 and a third switch SW3. One input terminal and an output terminal of the operational amplifier OP are coupled. The first switch SW1, the second switch SW2 and the third switch SW3 are coupled to the output terminal of the operational amplifier OP respectively. The operation of the first switch SW1, the second switch SW2 and the third switch SW3 are controlled by the switching unit 122. The switching unit 122 correspondingly controls whether the first switch SW1, the second switch SW2 and the third switch SW3 are conducted or not according to the lowest power consumption charge sharing way.

In addition, as to the first output channel CH1~the twelfth output channel CH12 in FIG. 4, each of the first output channel CH1~the twelfth output channel CH12 can also include an operational amplifier OP, a first switch SW1, a second switch SW2 and a third switch SW3, and so on.

Another preferred embodiment of the invention is a source driver operating method. In this embodiment, the source driver operating method is used to operate the source driver including output channels coupled to a panel. The output channels include M sets of output channels and each set of output channels includes 6N output channels, wherein M and N are positive integers.

Figure 10:
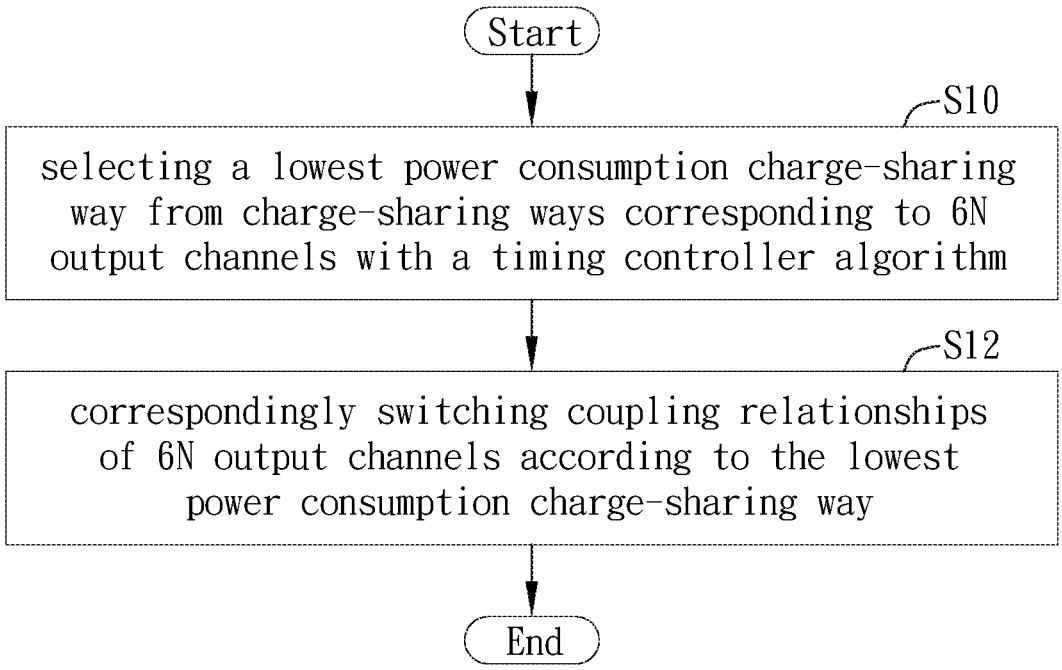
FIG. 10 illustrates a flowchart of the source driver operating method in another embodiment of the invention.

Please refer to FIG. 10. FIG. 10 illustrates a flowchart of the source driver operating method in this embodiment. As shown in FIG. 10, the source driver operating method can include following steps:

Step S10: selecting a lowest power consumption charge-sharing way from the charge-sharing ways corresponding to the 6N output channels with a timing controller algorithm; and Step S12: correspondingly switching the coupling relationships of the 6N output channels according to the lowest power consumption charge-sharing way. The lowest power consumption charge-sharing way is to randomly select K output channels from the 6N output channels to perform charge sharing, wherein K=0~6N.

Compared to the prior art, the source driver and operating method thereof in the invention cooperated with the timing controller algorithm to select a lowest power consumption charge-sharing way and corresponding switch the coupling relationships of the output channels of the source driver; therefore, no matter what the panel structure and the output polarity inversion method of the output channels of the source driver are, the source driver and operating method thereof in the invention can realize the charge sharing with the lowest power consumption to reduce power consumption of the liquid crystal display.

With the example and explanations above, the features and spirits of the invention will be hopefully well described. Those skilled in the art will readily observe that numerous modifications and alterations of the device may be made while retaining the teaching of the invention. Accordingly, the above disclosure should be construed as limited only by the metes and bounds of the appended claims.

What is claimed is:

1. A source driver, comprising:

a plurality of output channels coupled to a panel, the plurality of output channels comprising M sets of output channels and each set of output channel comprising 6N output channels, wherein M and N are positive integers;

a selection unit, for selecting a lowest power consumption charge-sharing way from a plurality of charge-sharing ways corresponding to the 6N output channels cooperated with a timing controller algorithm; and a switching unit, coupled to the selection unit and the 6N output channels, for correspondingly switching coupling relationships of the 6N output channels according to the lowest power consumption charge-sharing way;

wherein the lowest power consumption charge-sharing way is to randomly select K output channels from the 6N output channels to perform charge sharing, and $0 \leq K \leq 6N$; when N=1, the 6N output channels comprises a first output channel, a second output channel, a third output channel, a fourth output channel, a fifth output channel and a sixth output channel, $0 \leq K \leq 6$, the charge-sharing ways comprise:

(a) when K=0, no charge sharing being performed in the first output channel through the sixth output channel;

(b) when K=1, one output channel being randomly selected from the first output channel through the sixth output channel to perform charge sharing;

(c) when K=2, two output channels being randomly selected from the first output channel through the sixth output channel to perform charge sharing;

(d) when K=3, three output channels being randomly selected from the first output channel through the sixth output channel to perform charge sharing;

(e) when K=4, four output channels being randomly selected from the first output channel through the sixth output channel to perform charge sharing;

(f) when K=5, five output channels being randomly selected from the first output channel through the sixth output channel to perform charge sharing; and (g) when K=6, charge sharing being performed in all of the first output channel through the sixth output channel.

2. A source driver, comprising:

a plurality of output channels coupled to a panel, the plurality of output channels comprising M sets of output channels and each set of output channel comprising 6N output channels, wherein M and N are positive integers;

a selection unit, for selecting a lowest power consumption charge-sharing way from a plurality of charge-sharing ways corresponding to the 6N output channels cooperated with a timing controller algorithm; and a switching unit, coupled to the selection unit and the 6N output channels, for correspondingly switching coupling relationships of the 6N output channels according to the lowest power consumption charge-sharing way;

wherein the lowest power consumption charge-sharing way is to randomly select K output channels from the 6N output channels to perform charge sharing, and $0 \leq K \leq 6N$; each output channel of the output channels comprises an operational amplifier, a first switch and a second switch; an input terminal and an output terminal of the operational amplifier are coupled; the first switch and the second switch are coupled to the output terminal of the operational amplifier respectively and operations of the first switch and the second switch are controlled by the switching unit; the switching unit correspondingly controls the first switch and the second switch to be conducted or not according to the lowest power consumption charge-sharing way; the first switch and the second switch are not conducted at the same time.

3. A source driver, comprising:

a plurality of output channels coupled to a panel, the plurality of output channels comprising M sets of output channels and each set of output channel comprising 6N output channels, wherein M and N are positive integers;

a selection unit, for selecting a lowest power consumption charge-sharing way from a plurality of charge-sharing ways corresponding to the 6N output channels cooperated with a timing controller algorithm; and a switching unit, coupled to the selection unit and the 6N output channels, for correspondingly switching coupling relationships of the 6N output channels according to the lowest power consumption charge-sharing way;

wherein the lowest power consumption charge-sharing way is to randomly select K output channels from the 6N output channels to perform charge sharing, and $0 \leq K \leq 6N$; each output channel of the output channels comprises an operational amplifier, a first switch, a second switch and a third switch; an input terminal and an output terminal of the operational amplifier are coupled; the first switch, the second switch and the third switch are coupled to the output terminal of the operational amplifier respectively and operations of the first switch, the second switch and the third switch are controlled by the switching unit; the switching unit correspondingly controls the first switch, the second switch and the third switch to be conducted or not according to the lowest power consumption charge-sharing way.

* * * * *